US006378257B1

(12) United States Patent
Guerri

(10) Patent No.: US 6,378,257 B1
(45) Date of Patent: Apr. 30, 2002

(54) CLADDING COMPONENT MADE OF NATURAL OR SYNTHETIC STONE

(75) Inventor: Giancarlo Guerri, Viano (IT)

(73) Assignee: Sistema S.R.L., Castellarano (IT)

( * ) Notice: Subject to any disclaimer, the term of this patent is extended or adjusted under 35 U.S.C. 154(b) by 0 days.

(21) Appl. No.: 09/504,547

(22) Filed: Feb. 15, 2000

(30) Foreign Application Priority Data

Feb. 18, 1999 (IT) ..... MO99A0029

(51) Int. Cl.[7] ..... E04C 1/00
(52) U.S. Cl. ..... 52/309.1; 52/71; 52/293
(58) Field of Search ..... 52/179, 610, 800.1, 52/102, 169.7, 609, 721.1; 312/140.4, 108.27

(56) References Cited

U.S. PATENT DOCUMENTS 1,716,224 A * 6/1929 Friderichsen
3,750,197 A * 8/1973 Weir et al. ..... 52/293
D318,333 S * 7/1991 Niehaus et al. ..... D25/113
5,253,932 A * 10/1993 Nesovic ..... 312/140.3
6,258,190 B1 * 7/2001 Sciarrino et al. ..... 156/71

FOREIGN PATENT DOCUMENTS

| | | |
|---|---|---|
| DE | 42 15 424 | 11/1993 |
| FR | 2 734 752 | 12/1996 |

* cited by examiner

*Primary Examiner*—Carl D. Friedman
*Assistant Examiner*—Steve Varner
(74) *Attorney, Agent, or Firm*—Wolf, Greenfield & Sacks, P.C.

(57) ABSTRACT

A component made of natural or synthetic stone for cladding protruding parts in the building field, for example the front part of the steps of a staircase, comprising a tile which has, at its front edge, a first strip and a second strip which are respectively arranged at right angles and parallel to the tile, are mutually rigidly coupled and form a sort of a reversed L-shaped profiled element, the exposed surface of the profiled element being faced and fixing materials being interposed in the interspace between the strips and the front edge portion of the tile.

11 Claims, 3 Drawing Sheets

CLADDING COMPONENT MADE OF NATURAL OR SYNTHETIC STONE

CROSS-REFERENCE TO RELATED APPLICATIONS

This application claims priority to Italian Application Serial No. MO99A000029 filed Feb. 18, 1999, the disclosure of which is incorporated herein by reference.

BACKGROUND OF THE INVENTION

The present invention relates to a component made of natural or synthetic stone for cladding protruding parts in the building field, for example the front part of the steps of a staircase.

Conventionally profiled elements are used for finishing the edges of steps and the like or for blending protruding parts of furnishings, said profiled being constituted by a contoured element which is provided, in a rear region, with means for anchoring to the element for cladding the structure that constitutes the horizontal surface and/or to the structure itself and blends the surface and the vertical surface of the step or other protruding part of furnishings.

However, these profiled elements, known as "stair trims", suffer drawbacks, including the fact that they do not allow to obtain a uniform finish and a uniform color, since it is extremely difficult to obtain stair trims having the same shade of color as the parts to be finished.

Further conventional products for cladding the front part of steps and the like are constituted by a plurality of stacked tiles; in turn, these products require the use of pigmented bonding agents which must have the same color and shade as the tiles.

As an alternative, in order to obviate the above, these products can have, at the front edge of the stacked tiles, a contoured front which is glued to their exposed surface.

These products are in any case very heavy and expensive and require additional processes for facing the adjacent surfaces of the tiles; moreover, it is necessary to provide a cutout, or seat, on the front part of the structure that constitutes the horizontal surface of the step, in order to allow to position the product so as to avoid unaesthetic and dangerous differences in level.

The prior art also comprises products constituted by an upper tile which has, at the front and in a downward region, multiple portions of faced and stacked tiles which form a sort of finishing border for the protruding part.

In this case, with respect to products constituted by multiple stacked tiles, weight and size are partially reduced, but it is still necessary to carry out the additional operation of facing the surfaces that make mutual contact, in addition to the fact that the final thickness of the product is determined by the thicknesses of the stacked tile portions.

SUMMARY OF THE INVENTION

The aim of the present invention is to eliminate the above-noted drawbacks of conventional kinds of profiled element and product, providing a component made of natural or synthetic stone for cladding protruding parts in the building field, for example the front part of the steps of a staircase, which is variable in thickness and aesthetically valid, does not require the use of particular adhesives and pigments, is extremely compact and lightweight, and requires no additional operations for facing and forming cutouts and the like, as well as finishing elements.

Within the scope of this aim, an object of the present invention is to achieve the above aim with a structure which is simple, relatively easy to provide in practice, safe in use, effective in operation and relatively low in cost.

This aim and this object are both achieved by the present component made of natural or synthetic stone for cladding protruding parts in the building field, for example the front part of the steps of a staircase, characterized in that it comprises a tile which has, at its front edge, a first and a second strip which are respectively arranged at right angles and parallel to the tile, are mutually rigidly coupled and form a sort of a reversed L-shaped profiled element, the exposed surface of the profiled element being faced, fixing means being interposed in the interspace between the strips and the front edge portion of the tile.

BRIEF DESCRIPTION OF THE DRAWINGS

Further characteristics and advantages of the present invention will become apparent from the following detailed description of a preferred but not exclusive embodiment of a component made of natural or synthetic stone for cladding protruding parts in the building field, for example the front part of the steps of a staircase, illustrated only by way of non-limitative example in the accompanying drawings, wherein.

DESCRIPTION OF THE PREFERRED EMBODIMENTS

Figure 1:
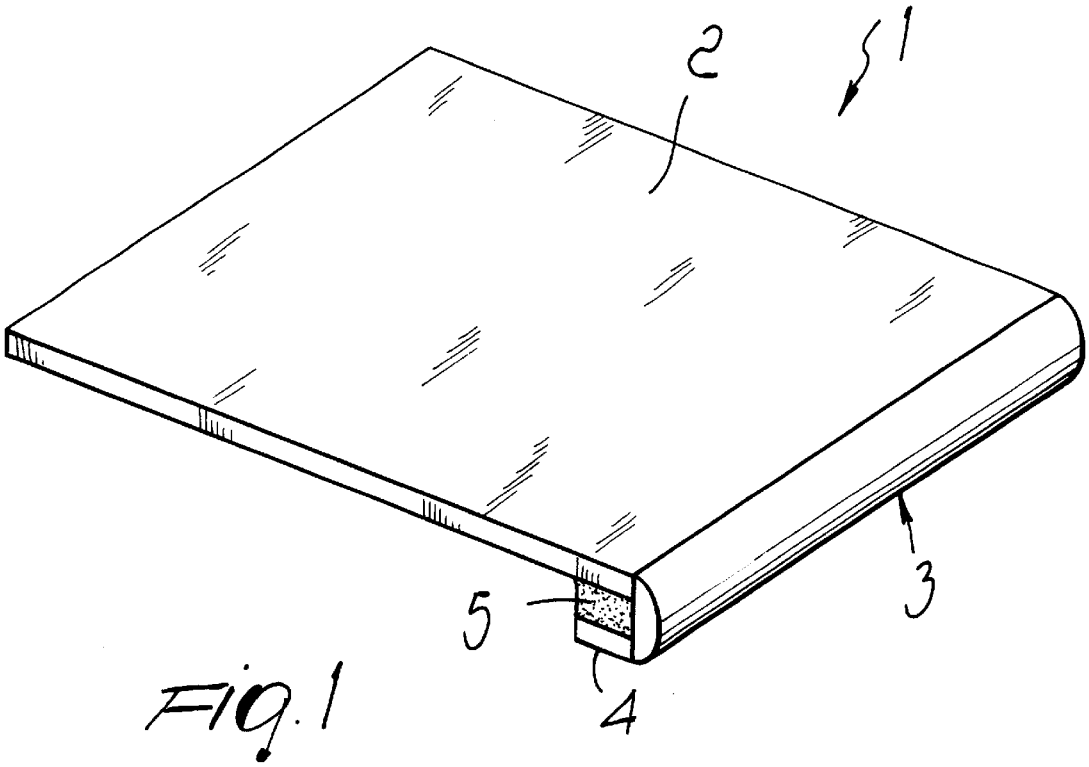
FIG. 1 is a perspective view, taken from above, of a component made of natural or synthetic stone for cladding protruding parts in the building field, for example the front part of the steps of a staircase.
Figure 2:
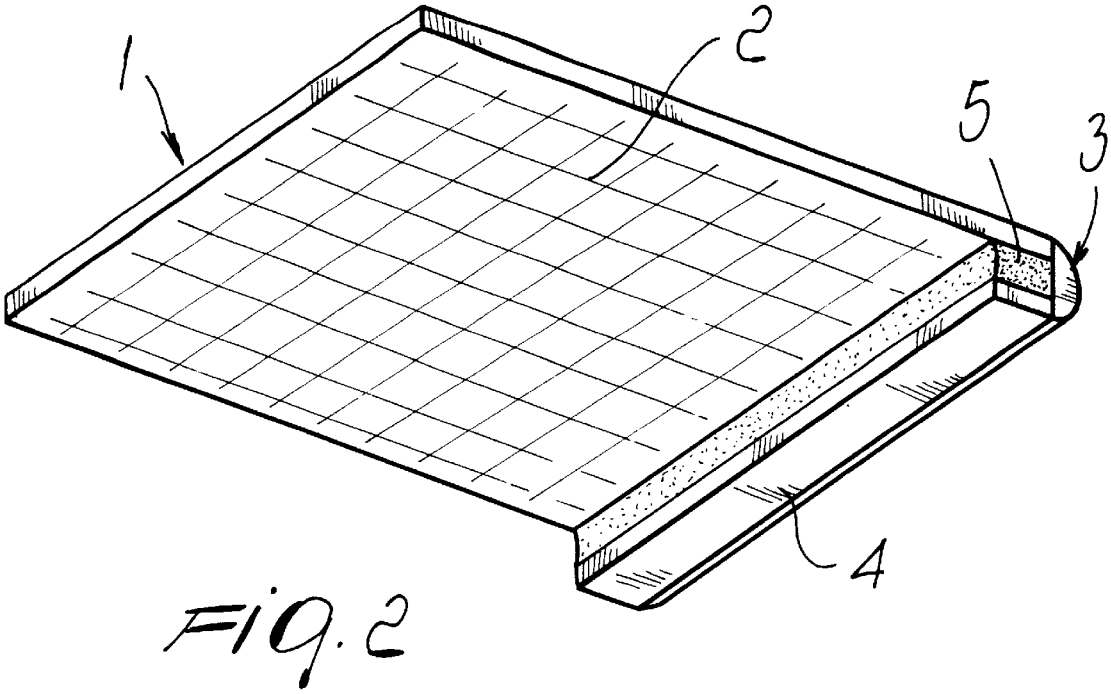
FIG. 2 is a perspective view, taken from below of the component of FIG. 1.
Figure 3:
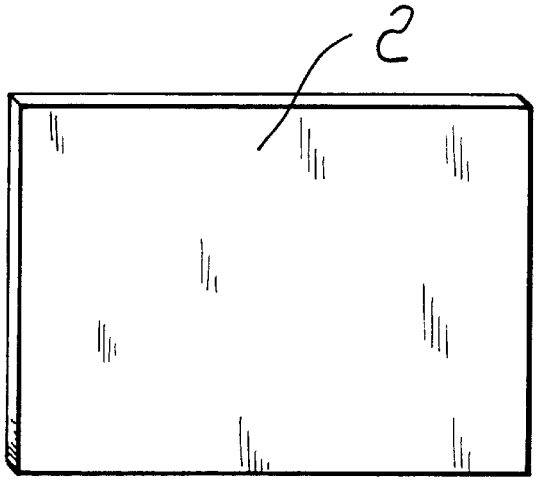
FIG. 3 is a front perspective view of the tile that constitutes the component according to the invention.

With reference to the above figures, 1 generally designates a component made of natural or synthetic stone for cladding protruding parts in the building field, for example the front part of the steps of a staircase.

The component 1 comprises a tile 2 which has, at its front edge, a first strip 3 and a second strip 4 which are arranged respectively at right angles to the tile 2 and parallel thereto and form a sort of reversed L-shaped profile.

The strips 3 and 4 are rigidly fixed to the tile 2, with interposed fixing means 5 in the interspace 6 formed by the internal surfaces of the strips and the front edge portion of the tile.

The exposed surface of the L-shaped profile is faced, by grinding, so as to form a sort of toroidal surface.

The profile and the tile are made of the same material and form eventually a single, monolithic body; advantageously, the strips are obtained directly from the tile by means of a cutting operation.

The first strip 3 is arranged so that its exposed surface 7 is in contact with the front edge of the tile 2 and so that its laying surface 8 is directed outwards and faced, as already mentioned, by grinding.

The means 5 for fixing the profile to the tile are constituted by adhesives and the like and determine the thickness of the component 1; conveniently, it is possible to insert in the interspace, in addition to the adhesives, wood or stone strips so as to be able to vary at will the thickness of the component to be manufactured and at the same time reduce the amount of adhesive to be introduced, thus reducing production costs.

The method for manufacturing the component 1 comprises a step for cutting the two strips 3 and 4, a step for assembling the strips and placing them on the front edge portion of the tile 2, a step for fixing the strips to the tile, and a step for facing the outer surface of the first strip 3.

Figure 4:
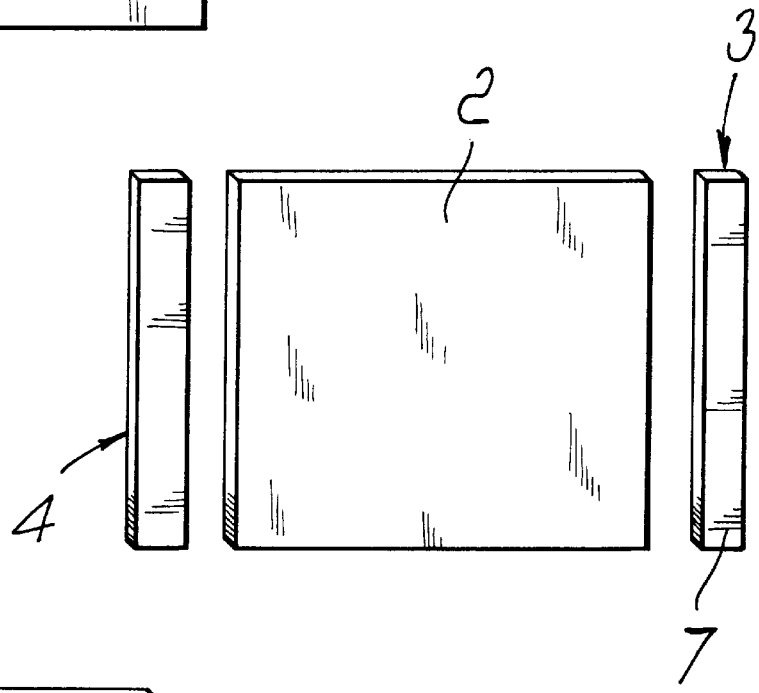
FIG. 4 is a front perspective view of the tile of FIG. 3 with the two cut and mutually opposite strips.

The cutting step (FIG. 4) consists in cutting the tile 2 with a tile cutter in order to make it assume the chosen dimensions and thus obtain a first strip 3 and a second strip 4.

Figure 5:
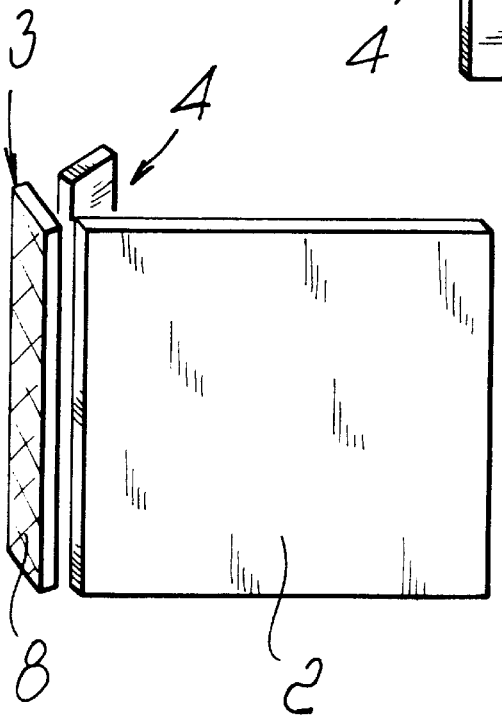
FIG. 5 is a front perspective view of the tile of FIG. 4, with the strips arranged mutually adjacent and adapted to be joined so as to form the component according to the invention.
Figure 6:
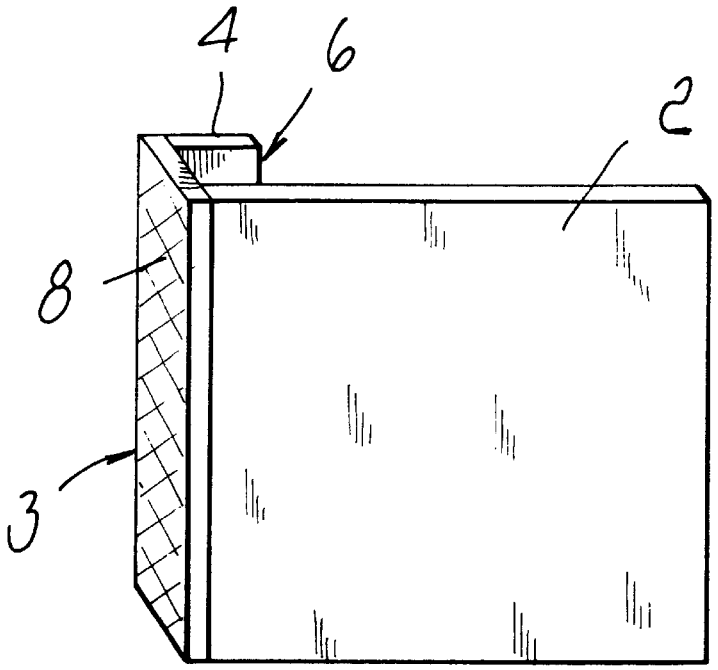
FIG. 6 is a perspective view of the tile of FIG. 4, with the strips joined so as to form the component according to the invention.

The assembly and positioning step (FIGS. 5 and 6) consists in joining the two strips 3 and 4 in a substantially right-angled arrangement so as to form an L-shaped profile and in arranging the resulting profile at the front edge of the tile 2 so that it faces backwards and so that the first strip 3 is perpendicular thereto.

In the first strip 3, the exposed surface 7 is in contact with the second strip 4 and the laying surface 8 faces outwards.

The strips are assembled and arranged at the front edge of the tile by means of adapted systems for pressing the parts and by using quick bonding systems, such as adhesives which dry in a few seconds.

Figure 7:
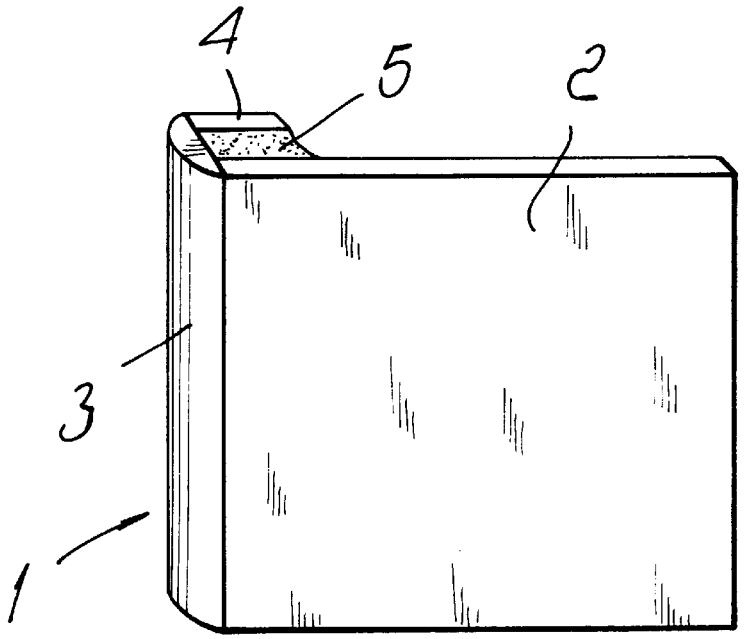
FIG. 7 is a perspective view of the component of FIG. 6, with fixing means interposed between the strips and the tile.

The fixing step (FIG. 7) consists in filling the interspace 6 between the front edge portion of the tile 2 and the two strips 3 and 4 with fixing means 5, such as adhesives and the like, which allow to obtain a monolithic body.

The facing step (FIG. 7) uses conventional grinders which perform complete facing of the laying surface 8 of the first strip 3 and determine the toroidal shape of the profile.

In practice it has been observed that the above-described invention achieves the intended aim and object, i.e. to be aesthetically valid, to have a reduced weight and to be particularly adapted for cladding the front part of steps or the like, without requiring stair trims or additional blending profiled elements.

The invention thus conceived is susceptible of numerous modifications and variations, all of which are within the scope of the appended claims.

All the details may further be replaced with other technically equivalent ones.

In practice, the materials employed, as well as the shapes and the dimensions, may be any according to requirements without thereby abandoning the protective scope of the appended claims.

The disclosures in Italian Patent Application No. MO99A000029 from which this application claims priority are incorporated herein by reference.

What is claimed is:

1. A cladding component made of natural or synthetic stone for cladding protruding parts of buildings, comprising:

a first tile, having a first face, a second face, a cross-sectional thickness defined as the distance between said first face and said second face, and a front edge;

a first tile strip, having a width larger than the cross-sectional thickness of the first tile, and including an exposed surface and a laying surface, wherein the exposed surface is parallel to the laying surface;

a second separate tile strip including an exposed surface and a laying surface, wherein the exposed surface is parallel to the laying surface; and wherein the first tile, the first tile strip and the second separate tile strip are arranged such that a portion of the exposed surface of the first tile strip is flush against the front edge of the first tile and the first tile strip is perpendicular to the second separate tile strip, positioned such that the exposed surface of the second separate tile strip is facing and parallel to the second face of the first tile, thereby creating an interspace defined by the second face of the first tile, an area of the exposed surface of the first tile strip and the exposed surface of the second separate tile strip, and an affixing means for securing the first tile, the first tile strip and the second separate tile strip is disposed in the interface.

2. The component of claim 1, wherein the first tile strip, the second separate tile strip and the first tile are made of the same material.

3. The component of claim 2, wherein the first tile strip and the second separate tile strip are derived from the first tile.

4. The component of claim 3, wherein the laying surface of the fist tile strip is faced by grinding.

5. The component of claim 1, wherein said fixing means are selected form a group including adhesives and other material with fixing characteristics.

6. The component of claim 1, wherein the first tile strip and the second separate tile strip are derived from tile other than the first tile.

7. A method of manufacturing a cladding component made of natural or synthetic stone for cladding protruding parts of buildings, comprising the steps of:

cutting a first strip and a second separate tile strip from the first tile, the first tile strip cut such that its width is larger than a cross-sectional thickness of the first tile wherein the cross-sectional thickness is defined as the distance between a first face and a second opposite face, the first tile strip and the second separate tile strip each having an exposed surface and a parallel and opposite laying surface;

assembling the component by arranging the first tile, the first tile strip and the second separate tile strip such that a portion of the exposed surface of the first tile strip is flush against a first tile, the first tile strip is perpendicular to the second separate tile strip and positioned such that the exposed surface of the second tile strip is facing and parallel to the second face of the first tile, thereby creating an interspace contained within the second face of the first tile, an area of the exposed surface of the first tile strip and the exposed surface of the second separate tile strip; and affixing the first strip, the second separate tile strip, and the first tile strip to the first tile.

8. The method of claim 7, wherein the cutting step consists of cutting the first tile strip and the second separate tile strip from the first tile.

9. The method of claim 7, wherein the step of assembling consists of joining the first tile strip and the second separate tile strip at a substantially right angle, such that an L-shaped profile is formed.

10. The method of claim 7, wherein the step of affixing consists of filling the interspace with an affixing means, consisting of adhesives or other materials with fixing characteristics.

11. The method of claim 7, wherein the step of facing consists of grinding the laying surface of the first tile strip.

* * * * *